US007351894B2

(12) United States Patent
Butler et al.

(10) Patent No.: US 7,351,894 B2
(45) Date of Patent: Apr. 1, 2008

(54) GUITAR STRING RETAINER GUIDE

(75) Inventors: Kelly M. Butler, Natick, MA (US); John A. McGuire, II, Newton, MA (US)

(73) Assignee: First Act Inc., Boston, MA (US)

( * ) Notice: Subject to any disclaimer, the term of this patent is extended or adjusted under 35 U.S.C. 154(b) by 127 days.

(21) Appl. No.: 11/286,361

(22) Filed: Nov. 25, 2005

(65) Prior Publication Data

US 2006/0070508 A1 Apr. 6, 2006

Related U.S. Application Data

(63) Continuation-in-part of application No. 10/674,705, filed on Oct. 1, 2003.

(51) Int. Cl.
*G10D 3/00* (2006.01)

(52) U.S. Cl. ..... 84/267; 84/313

(58) Field of Classification Search ..... 84/267, 84/290, 293, 291

See application file for complete search history.

(56) References Cited

U.S. PATENT DOCUMENTS 4,361,068 A * 11/1982 Schaller ..... 84/299
4,840,103 A * 6/1989 Mayer ..... 84/297 R
4,860,628 A * 8/1989 Storey ..... 84/313

* cited by examiner

*Primary Examiner*—Kimberly Lockett
(74) *Attorney, Agent, or Firm*—John E. Toupal; M. Brad Lawrence

(57) ABSTRACT

A stringed instrument including a body having a front surface and a rear surface, a tuning mechanism, a neck having one end joined to the body and an opposite end retaining the tuning mechanism, and a retainer block encompassed by the rear surface. A plurality of strings each have a first end secured to the tuning mechanism and a second end retained by the retainer block. Also included is a bridge system having a tailpiece mounted on the front surface and defining a plurality of holes each providing passage for one of the strings, and a connector assembly extending through the body and securing the tailpiece to the retainer block.

19 Claims, 6 Drawing Sheets

GUITAR STRING RETAINER GUIDE

This application is a Continuation-in-Part [CIP] of U.S. patent application Ser. No. 10/674,705 filed on Oct. 1, 2003, entitled STRING RETAINER FOR MUSICAL INSTRUMENTS.

BACKGROUND OF THE INVENTION

This invention relates generally to stringed musical instruments and, more particularly, to a guide retainer and arrangement for the strings of such instruments.

Traditional stringed instruments employ a plurality of strings which can be strummed to produce desired tonal sounds. Typically, the strings are fed between tuning screws mounted on a neck of the instrument and either ferrules retained by a rear surface of the instrument's body or a block mounted on a front surface thereof. Individual ferrules are undesirably subject to separation from the body upon breakage of an attached string while block string retainers retained on the instrument's front surface produce generally considered inferior tonal quality. U.S. patent application Ser. No. 10/674,705 discloses an improved system having a retainer block encompassed by a rear surface of an instrument body and a plurality of strings each having a first end secured to a tuning mechanism and a second end retained by the retainer block. Although the string retainer block disposed at the rear surface of the body alleviates problems associated with string breakage and enhances tonal performance of the instrument, further improvement in instrument performance is desirable.

The object of this invention, therefore, is to provide a stringed instrument offering improved tonal output and ease of use.

SUMMARY OF THE INVENTION

The invention is a stringed instrument including a body having a front surface and a rear surface, a tuning mechanism, a neck having one end joined to the body and an opposite end retaining the tuning mechanism, and a retainer block encompassed by the rear surface. A plurality of strings each have a first end secured to the tuning mechanism and a second end retained by the retainer block. Also included is a bridge system having a tailpiece mounted on the front surface and defining a plurality of holes each providing passage for one of the strings; and a connector assembly extending through the body and securing the tailpiece to the retainer block. The bridge connected retainer block and tailpiece enhance operation and performance of the instrument.

According to one feature of the invention, the connector assembly includes a plurality of threaded connectors extending between said retainer block and the tailpiece with each of the threaded connectors having a tool engageable head retained by the retainer block. Assembly of the instrument is simplified by the connector assembly.

According to another feature of the invention, the tailpiece has a plurality of alignment pegs extending into the body with each having a threaded bore receiving one of the connectors. The peg and connectors facilitate desired alignment of the tailpiece on the body.

According to yet other features, the tailpiece has an exposed curved surface intersecting the front surface and the holes are aligned in a direction transverse to the neck and the tailpiece is elongated with a full length extending in the transverse direction and substantially defining the exposed curved surface. These features reduce the possibility of finger injuries to operators of the instrument.

According to a further feature, each of the tailpiece holes defines a ramp surface curved about a radius of curvature and extending between the front surface and the curved surface of the tailpiece. The ramp surface reduces occurrence of string breakage

DESCRIPTION OF THE DRAWINGS

These and other objects and features of the invention will become more apparent upon a perusal of the following description taken in conjunction with the accompanying drawings wherein.

DESCRIPTION OF THE PREFERRED EMBODIMENT

Figure 1:
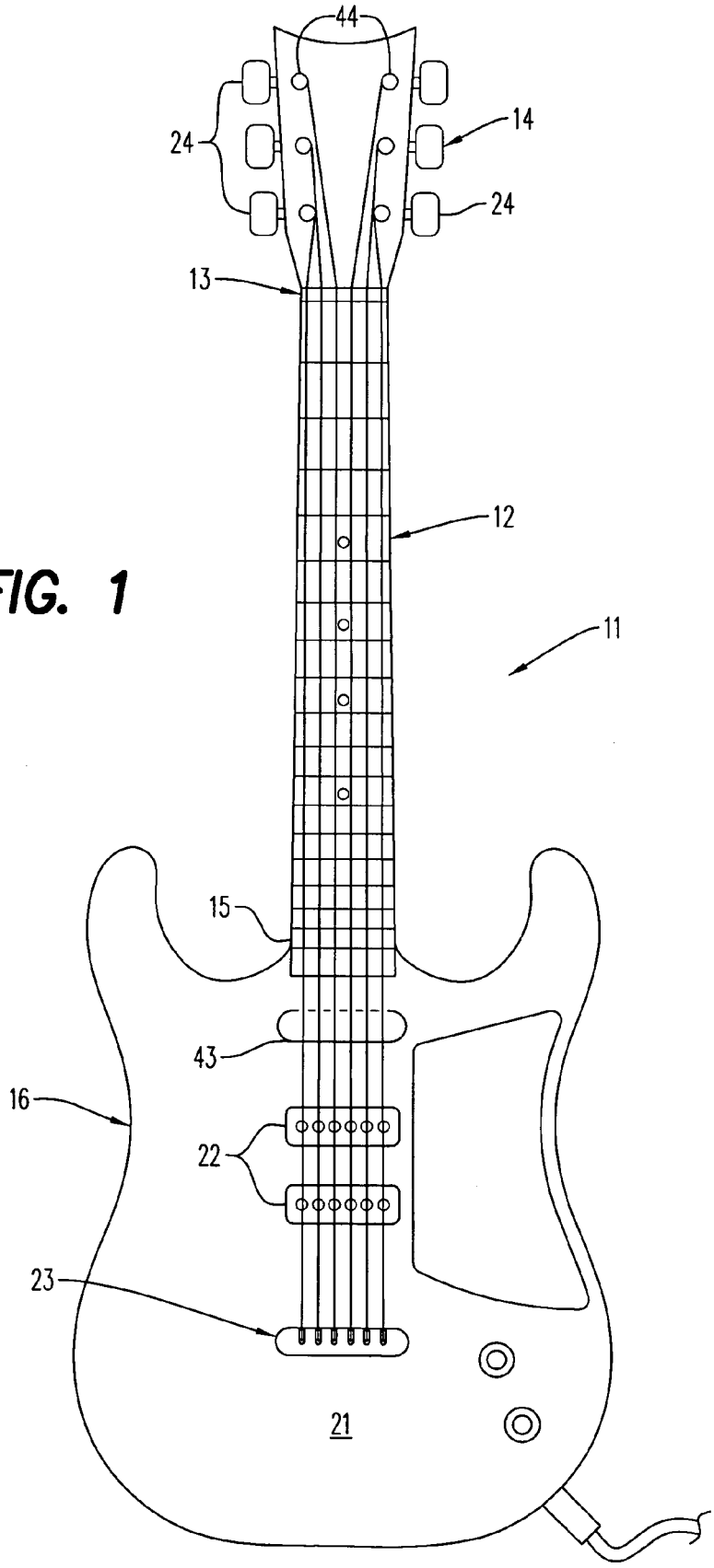
FIG. 1 is a top view of a stringed musical instrument according to the invention.

A stringed instrument 11 includes a neck 12 having one end 13 secured to a tuning mechanism 14 and an opposite end 15 secured to a body 16 as shown in FIG. 1. Mounted on a front surface 21 of the body 16 are pickups 22 and a bridge system including a string guide tailpiece 23. The tuning mechanism 14 includes a plurality of tuning screws 24.

Figure 2:
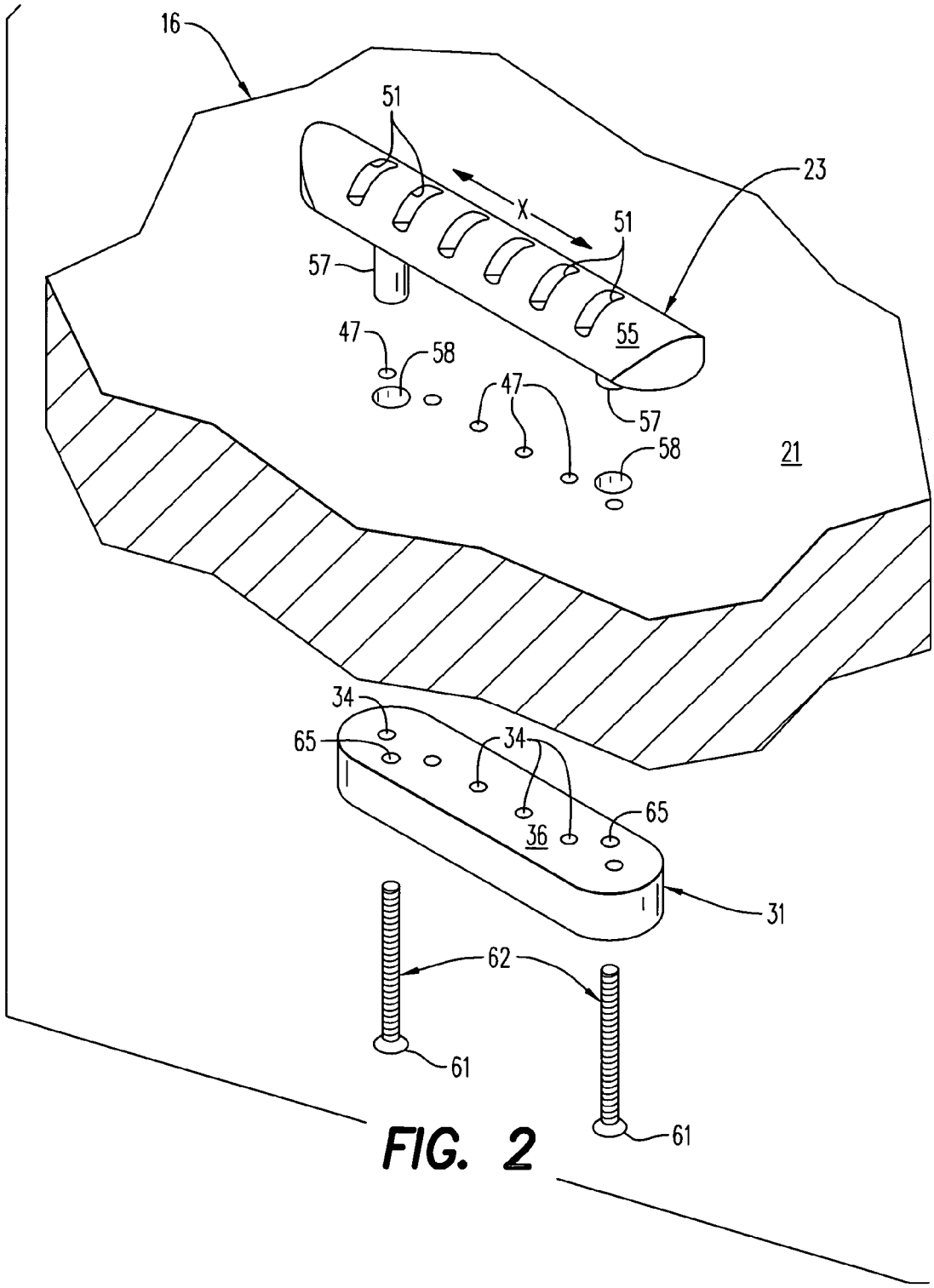
FIG. 2 is an exploded perspective view of a portion of the instrument shown in FIGS. 1 and 2.
Figure 3:
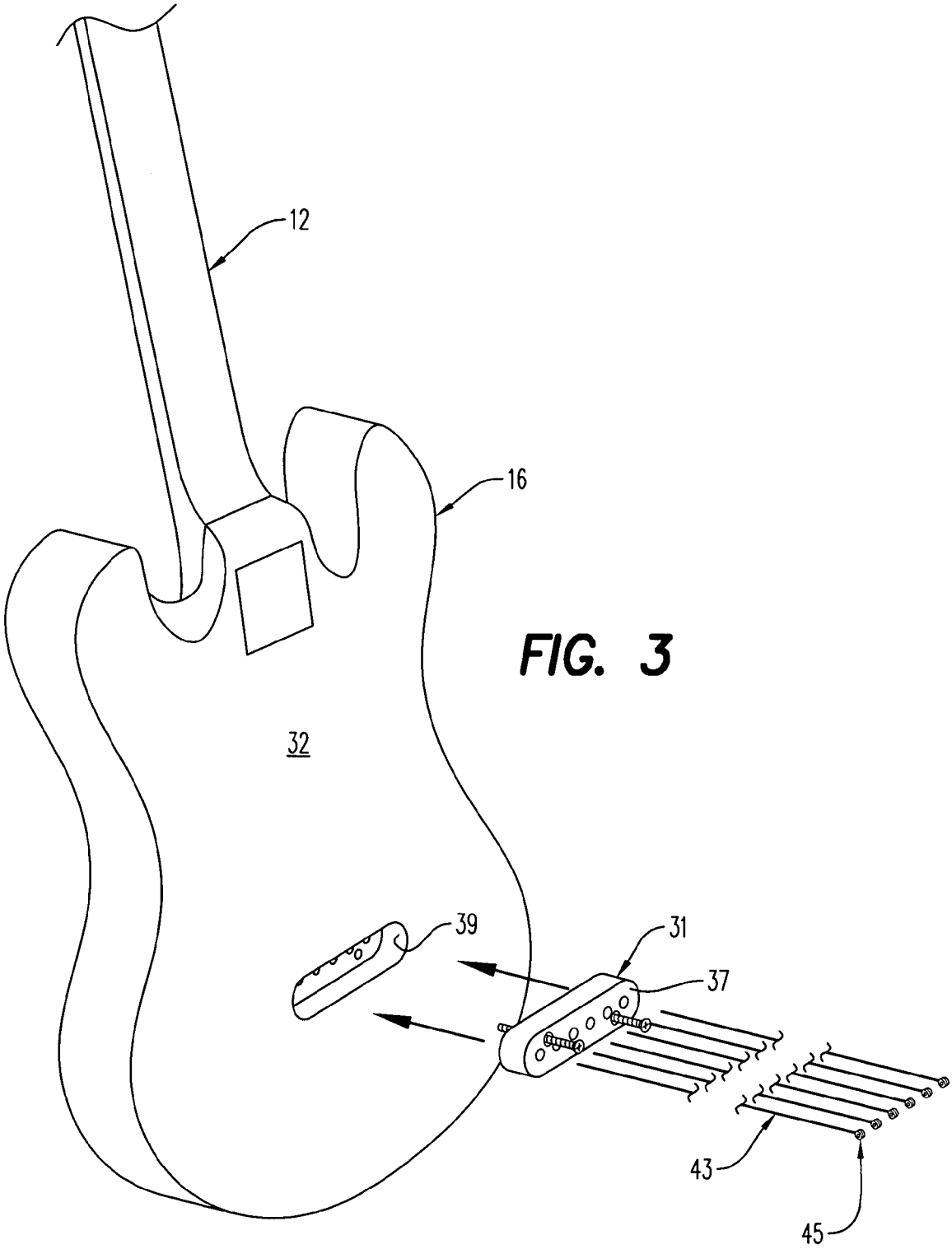
FIG. 3 is an exploded perspective view of the instrument shown in FIG. 1.
Figure 4:
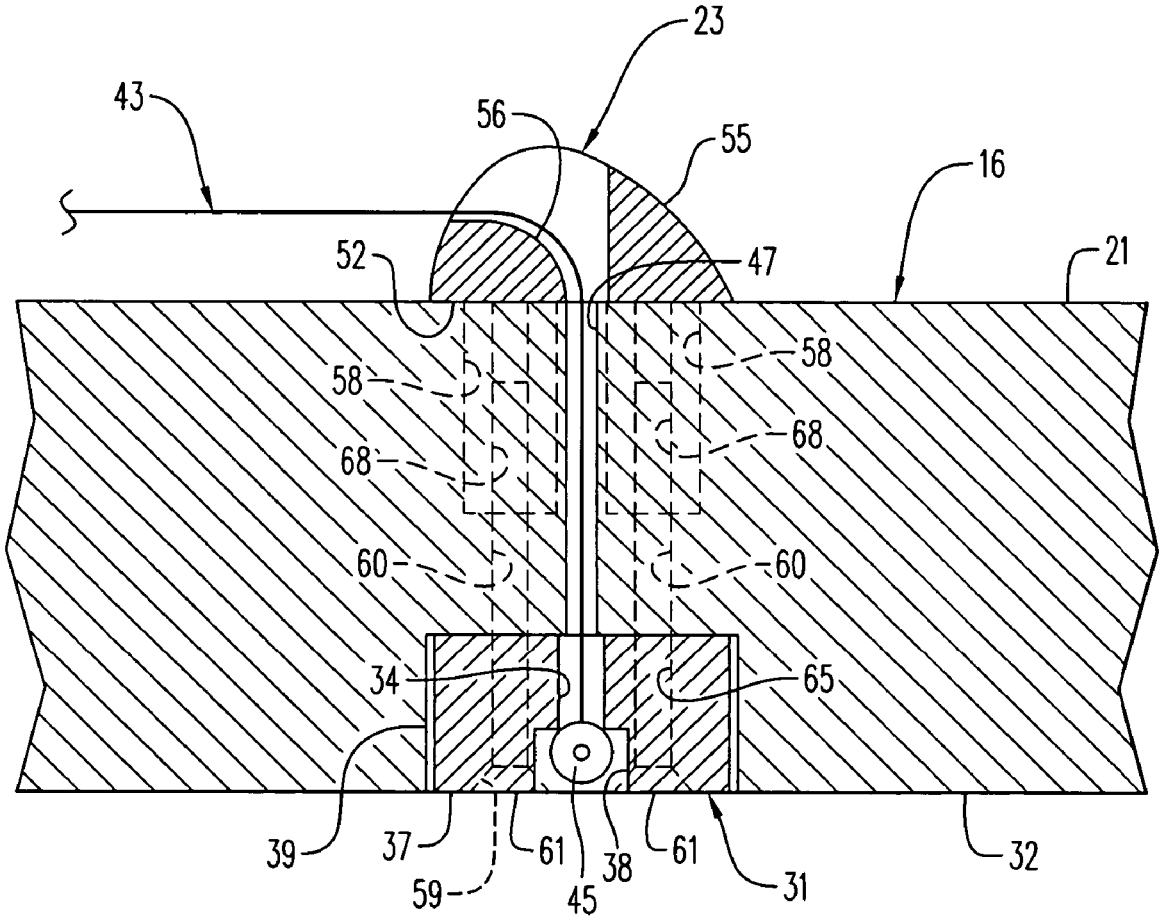
FIG. 4 is a detailed sectional view of a string guide and retainer arrangement of the instrument shown in FIGS. 1-3.

As depicted in FIGS. 2-4, a retainer block 31 is mounted on the body 16 and encompassed by a rear surface 32 thereof. The block 31 defines a plurality of cylindrical parallel passages 34 (FIG. 2) arranged in a linear array and extending between an inner surface 36 and an outer surface 37. Counterbore portions 38 of the passages 34 are formed in the outer surface 37 of the block 31 as shown in FIG. 4.

Preferably, the block 31 is made of brass and is retained in a cavity 39 defined by the body 16 and intersecting the rear surface 32 thereof.

The instrument 11 includes a plurality of strings 43 which can be strummed in a conventional manner to produce sound. Each of the strings 43 has a first end 44 secured to a different one of the tuning screws 24 (FIG. 1) and a second end 45 retained by a different counterbore 38 of the block 31 (FIG. 4). The second ends 45 are formed by enlarged ball anchors so as to prevent their passage through the channels 34. Between the tuning mechanism 14 and the block 31 each of the strings passes over the pickups 22 and are diverted by the tailpiece guide 23 through a slot 47 extending into the body 16 and intersecting the cavity 39.

Figure 5:
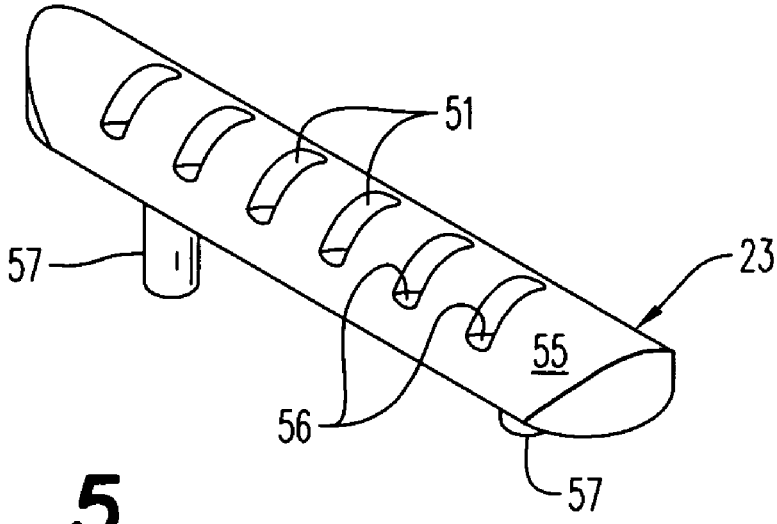
FIG. 5 is a top perspective view of a tailpiece guide used in the arrangement of FIG. 4.
Figure 6:
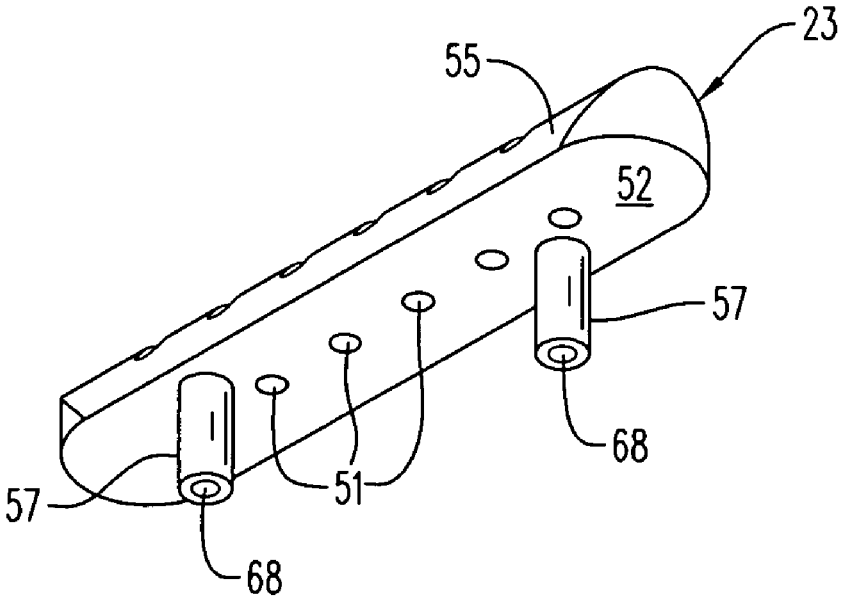
FIG. 6 is a bottom perspective view of the tailpiece guide.
Figure 7:
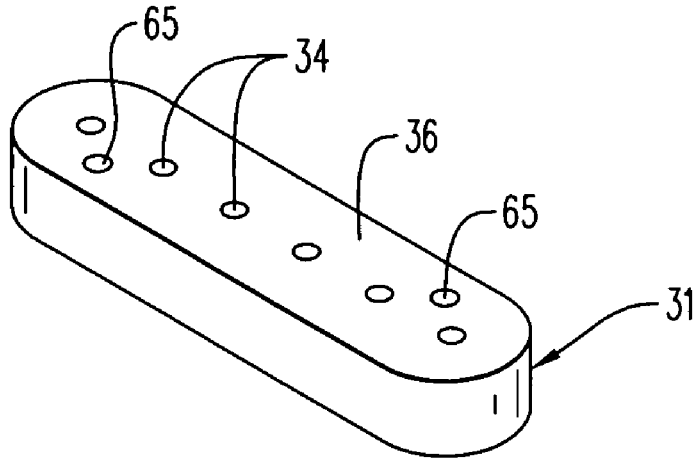
FIG. 7 is a top perspective view of the retainer block shown in FIG. 4.
Figure 8:
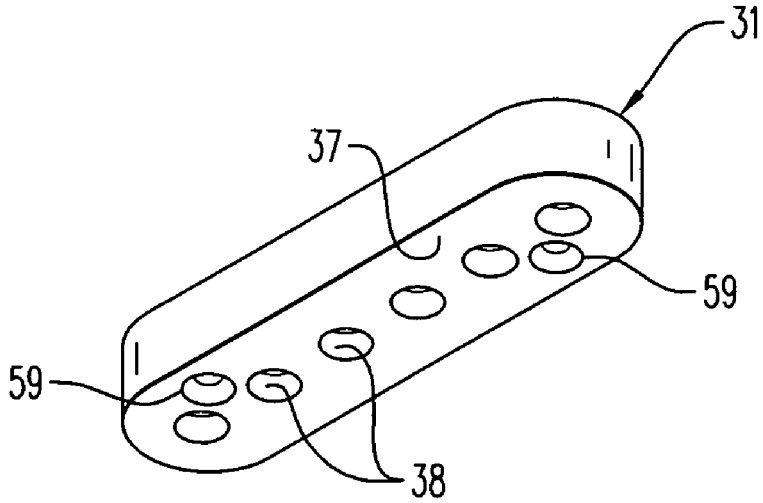
FIG. 8 is a bottom perspective view of the retainer block shown in FIGS. 4 and 7.

As illustrated most clearly in FIGS. 2, 5, and 6, the tailpiece 23 is a string guide preferably made of brass and elongated in a direction X transverse to the neck 12. The tailpiece 23 defines a plurality of holes 51 aligned in the direction X and each receiving (FIG. 4) one of the strings 43.

Supporting a concealed surface 52 (FIG. 4) of the tailpiece 23 is the front surface 21 while an exposed surface 55 thereof extends for substantially its entire length and is curved about an axis extending in the direction X. The exposed surface 55 intersects the front surface 21 of the body 16 as illustrated in FIG. 4. Defined by each of the holes 51 is a ramp surface 56 curved along a radius of curvature and extending between a joined slot 47 in the body 16 and the exposed surface 55.

A pair of alignment pegs 57 extend outwardly from the concealed surface 52 of the tailpiece 23 into upper openings 58 in the body 16 as shown in FIGS. 2 and 4. Each peg 57 is aligned with a lower opening 60 in the body 16 and an orifice 65 in the retainer block 31. A pair of counterbores 59 in the block 31 receive the heads 61 of a pair of connector screws 62. The externally threaded screws 62 extend through the orifices 65 in the retainer block 31 (FIGS. 2 and 4) and engage the threaded interiors 68 of the pegs 57 to both retain and align the tailpiece 23 on the front surface 21 of the body 16.

During use of the instrument 11, the tuning screws 24 are used to tighten the strings 43 to a degree desired to produce desired tonal sound output in response to strumming. The tonal output of the strummed strings 43 is enhanced by their passage through the body 16 and termination in the unitary brass block 31 and the physical joining of the retainer block 31 and the tailpiece 23 by the engaged pegs 57 and block supported screws 62. In addition, the radius of curvature of the ramp surfaces 56 reduce the occurrence of string breakage. However, even in the event that a string 43 is broken, the block 31 is not subject to undesirable separation from the body. In that case, the block 31 is retained in the cavity 39 by the remaining attached strings.

Obviously, many modifications and variations of the present invention are possible in light of the above teachings. It is to be understood, therefore, that the invention can be practiced otherwise than as specifically described.

What is claimed is:

1. A stringed instrument comprising:

a body having a front surface and a rear surface;

a tuning mechanism;

a neck having one end joined to said body and an opposite end retaining said tuning mechanism;

a retainer block encompassed by said rear surface;

a plurality of strings each having a first end secured to said tuning mechanism; and a second end retained by said retainer block;

a bridge system comprising a tailpiece mounted on said front surface and having an exposed curved surface intersecting said front surface and defining a plurality of holes each providing passage for one of said strings wherein said tailpiece is elongated with a full length extending in a direction transverse to the neck and substantially defining said exposed curved surface and wherein each of said holes defines a ramp surface curved about a radius of curvature and extending between said front surface of said body and said exposed curved surface; and connector means extending through said body and securing said tailpiece to said retainer block.

2. A stringed instrument according to claim 1 wherein said connector means comprises a plurality of threaded connectors extending between said retainer block and said tailpiece.

3. A stringed instrument according to claim 2 wherein each of said threaded connectors has a tool engageable head retained by said retainer block.

4. A stringed instrument according to claim 3 wherein said tailpiece comprises a plurality of alignment pegs extending into said body and each having a threaded bore receiving one of said connectors.

5. A stringed instrument according to claim 4 wherein said retainer block has an inner surface and an outer surface and defines a plurality of channels extending between said inner and outer surfaces, and each of said strings passes through a different one of said channels.

6. A stringed instrument according to claim 5 wherein said second ends are enlarged to prevent passage through said channels.

7. A stringed instrument comprising:

a body having a front surface and a rear surface;

a tuning mechanism;

a neck having one end joined to said body and an opposite end retaining said tuning mechanism;

a retainer block encompassed by said rear surface;

a plurality of strings each having a first end secured to said tuning mechanism; and a second end retained by said retainer block;

a bridge system comprising a tailpiece mounted on said front surface and defining a plurality of holes each providing passage for one of said strings; and connector means extending through said body and securing said tailpiece to said retainer block;

wherein said connector means comprises a plurality of threaded connectors extending between said retainer block and said tailpiece wherein each of said threaded connectors has a tool engageable head retained by said retainer block;

wherein said tailpiece comprises a plurality of alignment pegs extending into said body and each having a threaded bore receiving one of said connectors;

wherein said retainer block has an inner surface and an outer surface and defines a plurality of channels extending between said inner and outer surfaces, and each of said stings passes through a different one of said channels;

wherein said second ends are enlarged to prevent passage through said channels;

wherein each of said channels comprises a counterbore in said outer surface retaining one of said enlarged second ends.

8. A stringed instrument according to claim 1 wherein said tailpiece has an exposed curved surface intersecting said front surface and said holes are aligned in a direction transverse to said neck.

9. A stringed instrument according to claim 8 wherein said tailpiece is elongated with a full length extending in said direction and substantially defining said exposed curved surface.

10. A stringed instrument according to claim 9 wherein said connector means comprises a plurality of threaded connectors extending between said retainer block and said tailpiece.

11. A stringed instrument according to claim 10 wherein each of said threaded connectors has a tool engageable head retained by said retainer block.

12. A stringed instrument according to claim 11 wherein said tailpiece comprises a plurality of alignment pegs extending into said body and each having a threaded bore receiving one of said connectors.

13. A stringed instrument according to claim 12 wherein said retainer block has an inner surface and an outer surface and defines a plurality of channels extending between said inner and outer surfaces, and each of said strings passes through a different one of said channels.

14. A stringed instrument according to claim 13 wherein said second ends are enlarged to prevent passage through said channels.

15. A stringed instrument according to claim 14 wherein each of said channels comprises a counterbore in said outer surface retaining one of said enlarged second ends.

16. A stringed instrument according to claim 5 wherein said body defines a plurality of passages each aligned between a different pair of said holes and said channels.

17. A stringed instrument according to claim 16 wherein said second ends are enlarged to prevent passage through said channels.

18. A stringed instrument according to claim 17 wherein each of said channels comprises a counterbore in said outer surface retaining one of said enlarged second ends.

19. A stringed instrument comprising:

a body having a front surface and a rear surface;

a tuning mechanism;

a neck having one end joined to said body and an opposite end retaining said tuning mechanism;

a retainer block encompassed by said rear surface;

a plurality of strings each having a first end secured to said tuning mechanism;

and a second end retained by said retainer block; and a bridge system comprising a tailpiece mounted on said body and having an exposed curved surface intersecting said front surface, said tailpiece defining a plurality of holes aligned in a direction transverse to said neck and each providing passage for one of said strings, wherein said tailpiece is elongated with a full length extending in said direction and substantially defining said exposed curved surface and wherein each of said holes defines a ramp surface curved about a radius of curvature and extending between said front surface of said body and said exposed curved surface.

* * * * *